United States Patent [19]

Johnson

[11] 4,194,713

[45] Mar. 25, 1980

[54] TOOL HOLDER AND COMPONENTS THEREOF

[76] Inventor: Thomas L. Johnson, 520 Thalia Rd., Virginia Beach, Va. 23452

[21] Appl. No.: 866,106

[22] Filed: Dec. 30, 1977

[51] Int. Cl.[2] ..... A47B 96/06; E04G 3/00

[52] U.S. Cl. ..... 248/231; 24/68 E

[58] Field of Search ..... 249/231, 210, 316 A; 224/5 A, 5 J, 25 R; 24/68 E, 71.2, 68 R, 68.5 K, 68 CA, 68 BT, 68 T, 71 T, 71 ST, 71 TA

[56] References Cited

U.S. PATENT DOCUMENTS

| | | | |
|---|---|---|---|
| 1,925,431 | 9/1933 | Bishop | 224/5 AU X |
| 2,589,126 | 3/1952 | Payne | 224/25 R |
| 2,654,926 | 10/1953 | Delafosse | 24/68 E |
| 2,844,913 | 7/1958 | Brill | 24/35 X |
| 3,022,898 | 2/1962 | Loeb | 224/5 AU X |
| 3,091,827 | 6/1963 | Randrup | 24/68 E |
| 3,252,188 | 5/1966 | Davis | 24/68 E |
| 3,894,667 | 7/1975 | Baldocchi | 224/5 A X |
| 4,077,595 | 3/1978 | Carter | 248/210 |

FOREIGN PATENT DOCUMENTS

| | | | |
|---|---|---|---|
| 1138737 | 1/1969 | United Kingdom | 24/71 ST |

*Primary Examiner*—J. Franklin Foss
*Attorney, Agent, or Firm*—Geoffrey R. Myers

[57] ABSTRACT

Provided is an electrically non-conductive tool holder capable of being self-secured to the fiberglass boom of an aerial ladder comprising (1) a strap, (2) a means for tightening the strap comprised of a lever arm and retaining means each secured to the strap, and (3) a tool holder comprised of a flexible, bent biasing spring plate member having a looped tool holder strap extending between the bent sides of the plate.

25 Claims, 7 Drawing Figures

TOOL HOLDER AND COMPONENTS THEREOF

This invention relates to tool holders and components thereof. More particularly this invention relates to tool holders and components thereof safely useable in combination with aerial ladder booms.

Aerial ladder booms usually are supplied with a bucket at the end for carrying a worker aloft to perform various types of work. Such booms are often located on the rear of a truck chassis and are required to be raised aloft, using conventional hydraulics, to points adjacent electrical wires and the like.

The worker must often use tools at the aloft position such as poles, remote mount saws and the like to perform his work. For safety he is electrically insulated from ground usually by forming the boom of an electrically non-conductive material such as fiberglass. Tool holders are often needed to hold the tools used by the workers. As such, they must be electrically non-conductive themselves, capable of being tightly secured to the boom so as to prevent accidental slippage along the boom length, securable to the boom without violating the integrity and thus strength of the boom by use of bolts, screws or the like, and capable of tightly holding the tool, but with easy release.

The prior art has heretofore not successfully accomplished the above and, thus, a need is defined. It is a purpose of this invention to fulfill this and other needs more apparent to the skilled artisan once given the following description of this invention.

Generally speaking, this invention provides for certain novel tool holders and unique components thereof generically useful, but finding particular utility when used on aerial ladder booms. As such, there is provided a device for holding a tool comprising a strap means for wrapping about a support, and two unique components: (1) a means for tightening the strap when wrapped about the support, and (2) a means for holding a tool, the tightening means and tool holding means being retained on the strap.

The tightening means comprises a lever member having a fulcrum end and a retaining end, and a retaining member for releasably securing the retaining end of the lever member in place, the lever member and retaining member being retained on the strap in such a way that when the retaining end of the lever member is secured in the retaining member, the strap is tightened by force applied at the fulcrum end of the lever member and when the retaining end of the lever member is released from the retaining member, the strap is loosened by relieving the force applied at the fulcrum end of the lever member.

The tool holding means comprises a tool holder and a means for opening and closing the tool holder, the opening and closing means comprising a resilient spring plate member bent at a point intermediate its ends such that one side of the plate is normally biased toward the other, the tool holder being attached to respective sides of the plate such that the normal bias of the resilient spring plate member closes the tool holder and the application of force to separate the sides of the flexible spring plate member against the normal bias of the plate member opens the tool holder and such that upon release of the force the bias of the plate member automatically returns the tool holder to its closed position.

In certain preferred embodiments the devices of this invention and all of its components are made of electrically non-conductive material such as plastics of either the thermoplastic or thermosetting type and/or fiberglass re-enforced by known resins such as epoxies and the like. In further preferred embodiments, particularly when used in combination with aerial ladder booms, the tightness of the strap constitutes the sole means for securing the device to the support (e.g. boom) in that bolts, screws, etc., are not used.

This invention will now be described with respect to certain embodiments thereof in concert with various illustrations wherein:

IN THE DRAWINGS

Figure 1:
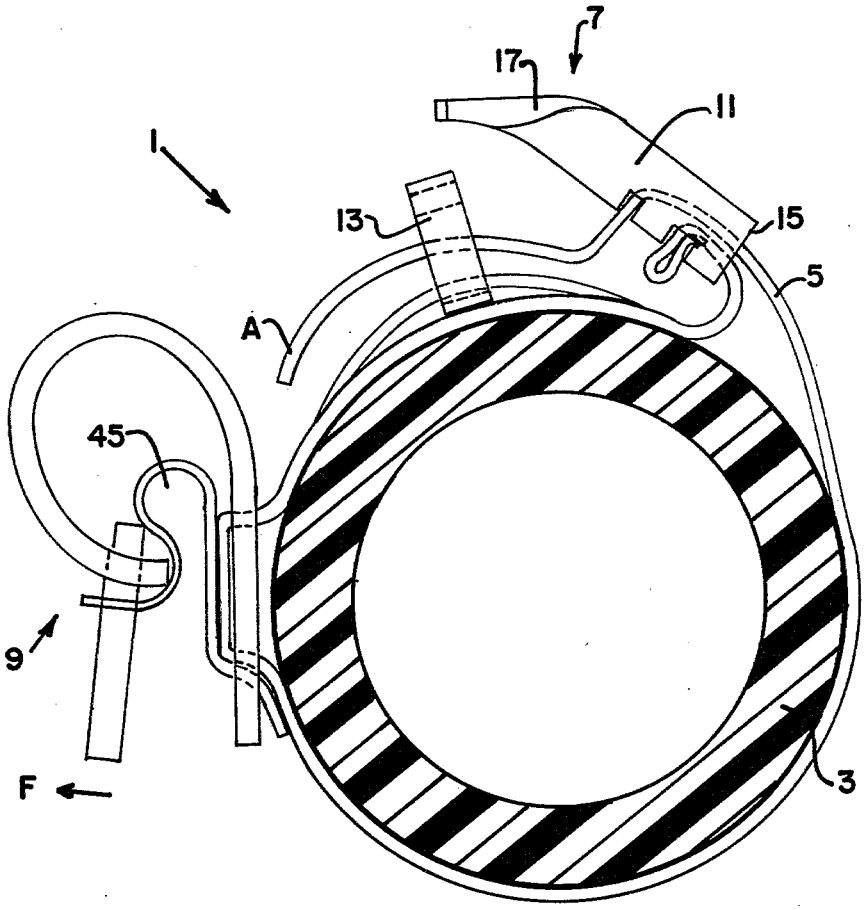
FIG. 1 is a side plan, partially sectionalized view of an embodiment of this invention.

With reference initially to FIG. 1, there is illustrated a work holding device 1 loosely attached to a typical fiberglass aerial ladder boom 3. Device 1 includes a flexible relatively thin strap 5, a strap tightening member 7, and a tool holding member 9.

Figure 2:
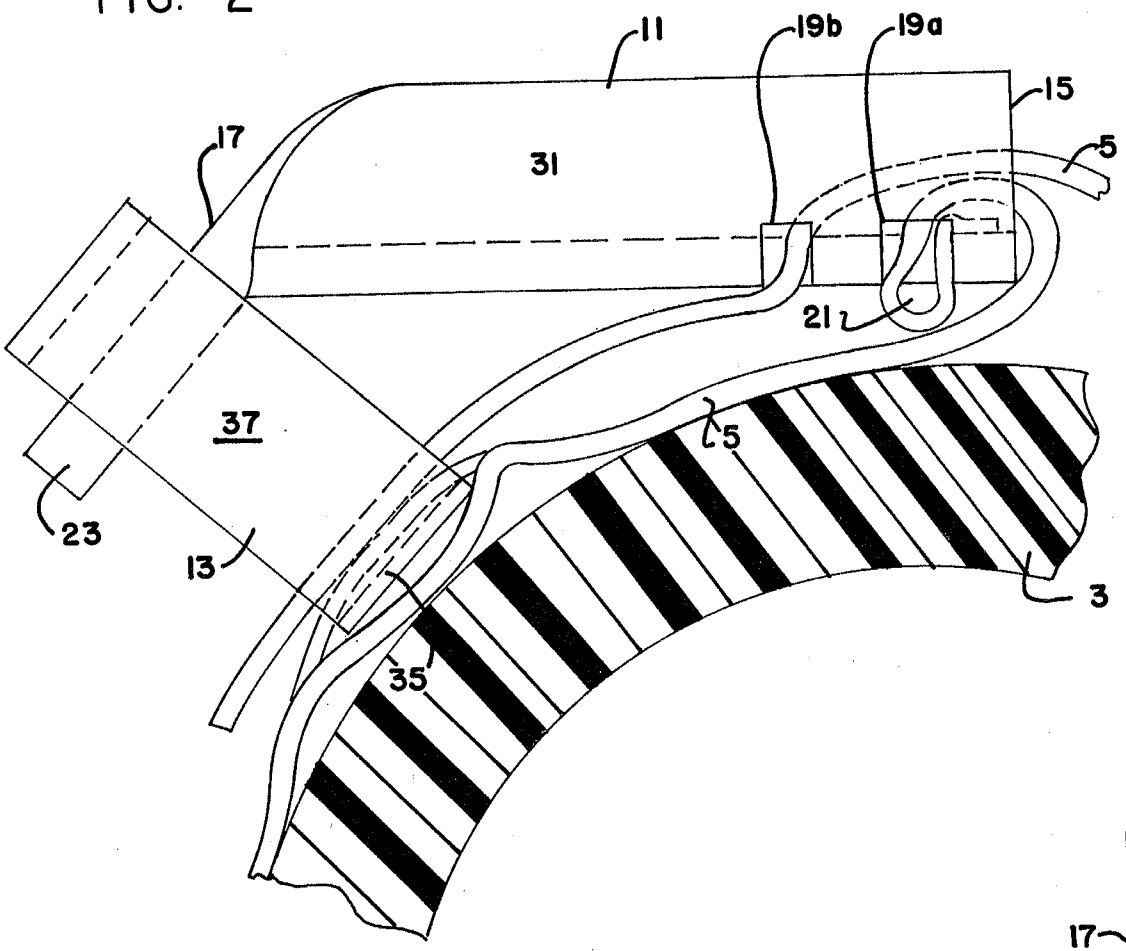
FIG. 2 is a side plan, partially sectionalized view of the strap and tightener component of the embodiment of FIG. 1.

Strap tightening member 7, shown in its open (or loosened) position in FIG. 1, includes a lever member 11 and a retaining member 13. FIG. 2 illustrates member 7 in its retaining or (tightening) position.

Figure 4:
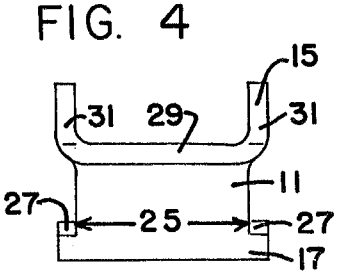
FIG. 4 is a front plan view of the lever member of FIG. 3.
Figure 5:
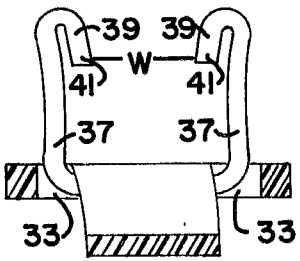
FIG. 5 is a front plan, partially sectionalized view of the retaining member of the tightener component of the embodiment of FIG. 2 located in the strap.
Figure 3:
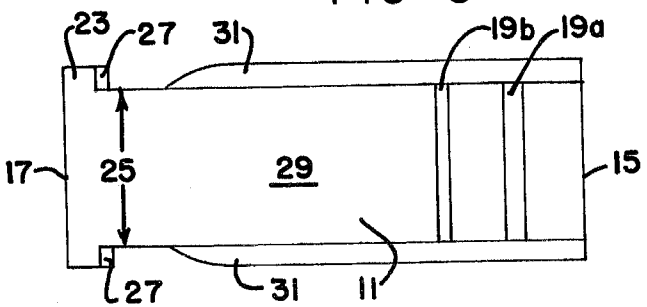
FIG. 3 is a top plan view of the lever member of the tightener component of FIG. 2.

As further illustrated in FIGS. 3–4, "lever member" includes a fulcrum end 15 and a retaining end 17. Adjacent fulcrum end 15 are a pair of strap retaining slots 19*a, b*. Slot 19*a* is of a width greater than slot 19*b* because, as illustrated, strap 5 initiates at loop hold 21 in slot 19*a*. If strap 5 were to initiate at 19*b*, this slot would be larger than 19*a*. Given a strap of about ⅛" thickness, slot 19*a* may be about ¼" and 19*b* and 3/16".

Retaining end 17 includes a lateral flange 23 and a portion 25 anterior to flange 23 of lesser width, thus, to define stop surfaces 27 which aid in locking retaining end 17 into retaining member 13. Retaining end 17 is bent at an angle with respect to fulcrum end 15 to provide better locking and tightening. Fulcrum end 15 is generally cup shaped having a base plate 29 and upstanding side walls 31. This shape provides a convenient housing for the overlapping of strap 5 adjacent fulcrum end 15.

Retaining member 13 is located downstream of strap 5 in the sense that it is secured to strap 5 after the strap wraps around fulcrum end 15 and under lever member 11. Retaining member 13 is attached to strap 5 by sliding it through two adjacent longitudinal slits 33 provided in strap 5.

Member 13 is generally U-shaped having a base 35 and upstanding resiliently flexible legs 37. Ends 39 of legs 37 are looped inwardly and downwardly such that stop surfaces 41 are formed for securely holding lever member 11 therein. Ends 39 downwardly converge and are spaced from each other a distance W which is less than the width of portion 25 of lever 11. Flange 23 on the other hand is longer (laterally) than distance W. In this way, an effective tightening mechanism for strap 5 is provided.

Strap tightener 7 operates in the following way. Strap 5 is initially placed around boom 3 and the strap end "A" slipped through slot 19*b* and between legs 37 as illustrated in FIG. 1. Strap end A is then pulled by hand to tighten the strap somewhat on boom 3. In this posture strap 5 initiates from its loop at 19*a*, wraps around end 15 and under lever member 11 thereafter to secure retainer member 13 within slits 33. Retaining end 17 of lever 11 is then pushed downwardly toward leg ends 39. This action causes fulcrum end 15 to pull strap 5 and securely tighten it on boom 3 since the action also binds strap 5 in relatively thin slot 19*b*. Continued pushing of retaining end 17 forces flexible legs 37 to flex apart until portion 25 is located below surface 41. When this occurs, legs 37 automatically snap back into there normally inwardly biased position (i.e., where the distance is W) thereby locking lever member 11 within retaining member 13. This in turn tightly secures strap 5 to boom 3 without the need of further fastener or other securing means. This locked position is illustrated in FIG. 2.

Tool holding member 9 is secured to strap 5 downstream of retaining member 13. Member 9 includes a flexible tool holder strap or belt 43 which forms a loop 45 for retaining a work piece 47 therewithin. An opening and closing mechanism for belt 43 includes a resilient spring plate member 49, bent at a point B intermediate its ends. The upper side of plate 49 is provided with a handle 51 and the lower side is provided with a pair of slots 53*a,b*. Slot 53*a* is of larger width than 53*b* because both strap 5 and belt 43 are retained therein, while 53*b* retains only strap 5. If this retention is reversed, slot 53*b* would be larger than slot 53*a*. For ⅛" straps and belts, 53*a* is typically about ⅜" and 53*b* is about 3/16".

The upper end of belt 43 extends under abutting end 55 of plate 49 and the lower end of belt 43 extends through slot 53*a*. By adjusting the extent to which the lower end of belt 43 extends through slot 53*a*, the size of loop 45 is adjusted, thus making member 9 adoptable to a wide variety of sizes and shapes of tools.

Figure 6:
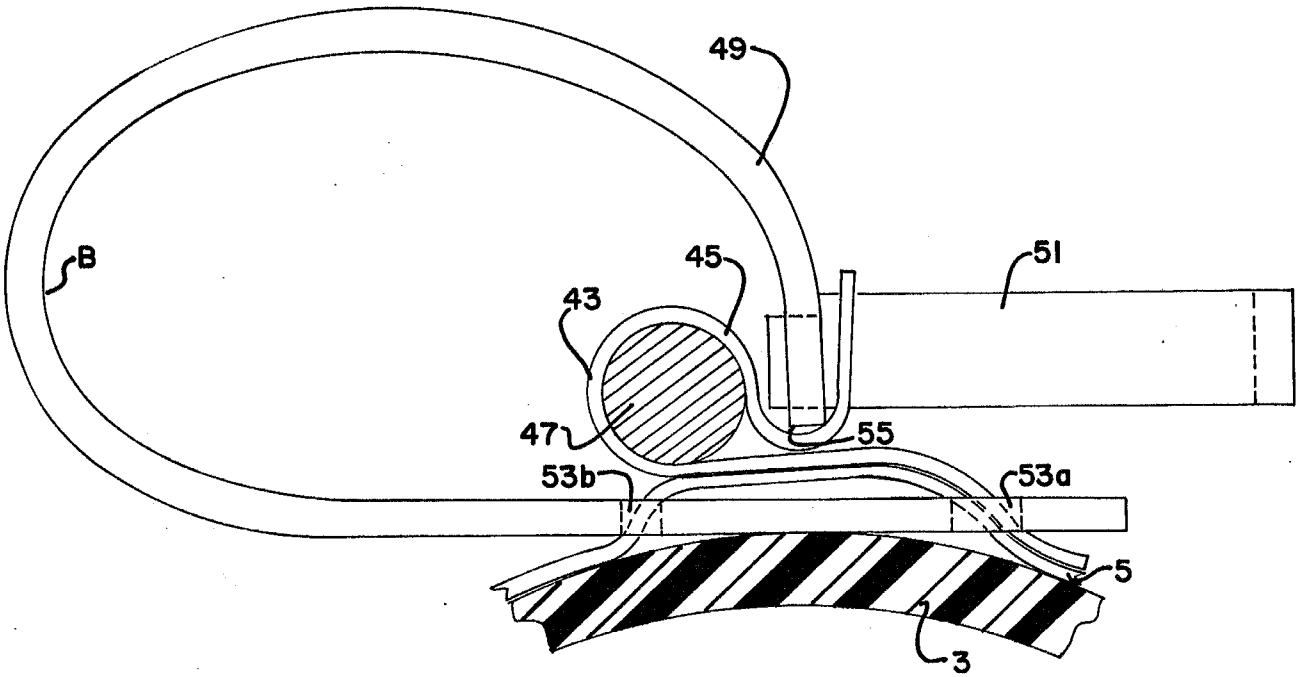
FIG. 6 is a side plan, partially sectionalized view of the strap and tool holder component of the embodiment of FIG. 1.
Figure 7:
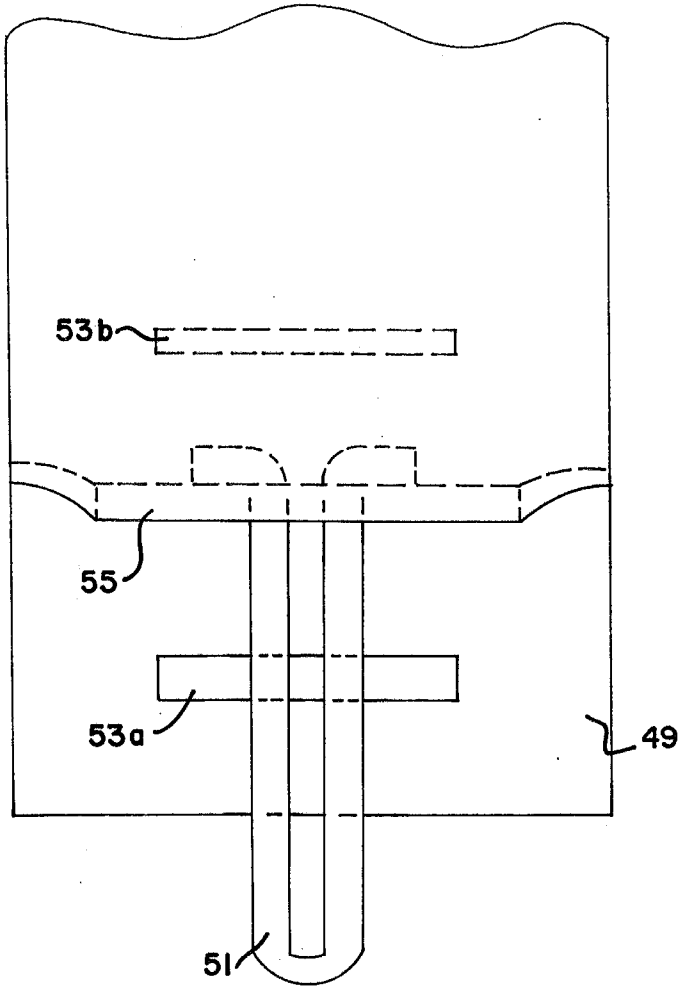
FIG. 7 is a top plan view of the spring plate member of the tool holder component of FIG. 6.
Figure 8:
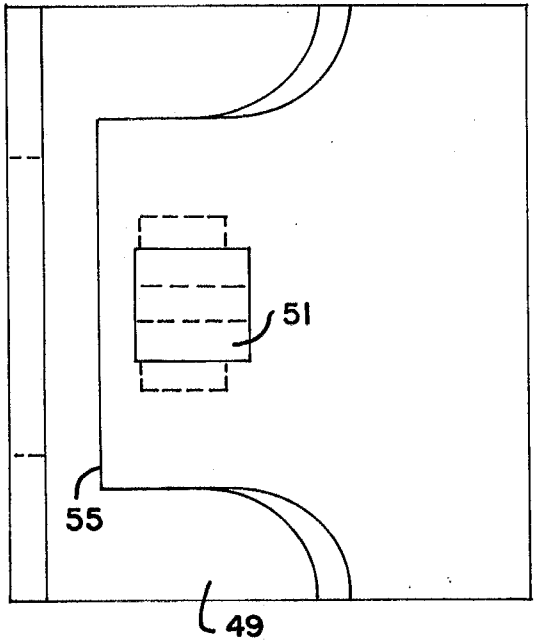
FIG. 8 is a front plan view of FIG. 7.

Bend "B" is sufficient so as to normally bias resilient spring plate member 49 into the closed position as illustrated in FIG. 6. The closed position does not necessarily require the pinching of the two sides of belt 43 together. It may in some instances merely require that loop 45 be rendered sufficiently small to tightly secure a work piece (tool) 47 therewithin.

Upon application of force F to handle 51, the upper side of plate 49 is raised against its normal bias thus opening loop 45 as illustrated in FIG. 1. Work piece 47 may then be easily inserted therein. Upon release of force F on handle 51, the upper surface of plate 49 automatically snaps to its closed position tightly securing work piece 47 within loop 45. The entire member 9 is tightly retained on strap 5 and the lower end of belt 43 is tightly secured in slot 53*a* when strap 5 is tightened by the action of strap tightening member 7.

All components of this invention may be made of conventional materials known to be capable of performing there intended functions. Strap 5 may be made of a cloth laminate reinforced with plastic or rubber layers. A 2" wide strap of ⅛" thickness has proved acceptable for most intended purposes, is electrically non-conductive and is capable of retaining relatively heavy work pieces solely by its tightness (without screws, ets.) on the boom. The other components may likewise be of an electrically non-conductive material such as polypropylene or other known synthetic materials capable where required of providing spring action, resiliency and the like.

Once given the above disclosure, many other features, modifications and improvements will become apparent to the skilled artisan. Such features, modifications and improvements are therefore considered a part of this invention, the scope of which is to be determined by the following claims.

I claim:

1. A device for holding a tool comprising a strap means for wrapping about a support, a means for tightening said strap when wrapped about the support and a means for holding a tool, the tightening means and tool holding means being retained on said strap, said tightening means comprising a lever member having a fulcrum end and a retaining end, and a retaining member for releasably securing the retaining end of the lever member in place, said lever member and retaining member being retained on said strap in such a way that when the retaining end of the lever member is secured in said retaining member the strap is tightened by force applied at the fulcrum end of the lever member and when the retaining end of the lever member is released from the retaining member, the strap is loosened by relieving the force applied at the fulcrum end of the lever member, and wherein:

said retaining means comprises a generally U-shaped member whose base is secured to said strap and whose legs are flexible and include means for releasably retaining the retaining end of said lever member between said legs, and said lever member comprises a longitudinally extending plate means, said retaining end comprising a lateral flange wider than the distance between the flexible legs of the U-shaped retaining member and having, longitudinally anterior to said flange, a portion of a width slightly greater than the normally unbiased distance between the flexible legs of the U-shaped retaining member; and said tool holding means comprising a tool holder and a means for opening and closing said tool holder, said opening and closing means comprising a resilient spring plate member bent at a point intermediate its ends such that one side of said plate is normally biased toward the other, said tool holder being attached to respective sides of said plate such that the normal bias of said resilient spring plate member closes said tool holder and the application of force to separate the sides of said flexible spring plate member against the normal bias of said plate member opens said tool holder and such that upon release of said force the bias of said plate member automatically returns the tool holder to its closed position.

2. A device according to claim 1 wherein said lever member is provided with a pair of strap retaining slots adjacent its fulcrum end, said strap emerging from one of said slots and extending around said fulcrum end and under said lever member in the direction of its retaining end.

3. A device according to claim 2 wherein the slot from which said strap emerges is the slot closest the fulcrum end and wherein said strap after it extends therefrom around said fulcrum end and said support, further extends over said fulcrum end, through the other of said strap retaining slots and under said lever member.

4. The device according to claim 3 wherein said strap at a point after which it extends around said fulcrum end in the direction of the retaining end is provided with a means for securing said retaining member to said strap.

5. The device according to claim 4 wherein said means for securing said retaining member to said strap comprises a pair of adjacent longitudinal slits in said strap.

6. The device according to claim 4 wherein said lever member is bent at an angle intermediate its retaining and fulcrum ends.

7. The device according to claim 6 wherein the upper ends of the legs of the U-shaped retaining member are inwardly and downwardly bent a finite distance less than the height of the legs thereby to define a retaining flange for the retaining end of said lever member when retained in said retaining member.

8. The device according to claim 7 wherein said strap is secured to said tool holding means by a pair of adjacent laterally extending slots provided in one side of said resilient spring plate member.

9. The device according to claim 8 wherein said strap enters the first of said pair of laterally extending slots from under said plate member, extends over to and through said other of said pair of laterally extending slots and exits therefrom under said plate member to continue around said support.

10. The device according to claim 9 wherein said resilient spring plate member is provided with a handle means on the side opposite that side which contains said laterally extending slots.

11. The device according to claim 10 wherein said tool holder is comprised of a flexible belt extending between the two sides of said plate, one end of said belt extending through one of said laterally extending slots and the other end of said belt being secured to said handle means.

12. The device according to claim 11 which is made of electrically non-conducting material.

13. The device according to claim 4 which is made of electrically non-conducting material.

14. The device according to claim 1 which is made of electrically non-conducting material.

15. In the combination of an aerial ladder boom having attached thereto a device for holding a tool, the improvement comprising the device of claim 1.

16. In the combination of an aerial ladder boom having attached thereto a device for holding a tool, the improvement comprising the device of claim 4, said device being attached to said boom solely by the tightness of said strap.

17. In the combination of an aerial ladder boom having attached thereto a device for holding a tool, the improvement comprising the device of claim 12.

18. In the combination of an aerial ladder boom having attached thereto a device for holding a tool, the improvement comprising the device of claim 15, said device being attached to said aerial ladder boom solely by the tightness of said strap.

19. A strap tightening device comprising a lever member having a fulcrum end and a retaining end, and a retaining member for releasably securing the retaining end of the lever member in place, said lever member and retaining member being retained on said strap in such a way that when the retaining end of the lever member is secured in said retaining member, the strap is tightened by force applied at the fulcrum end of the lever member and when the retaining end of the lever member is released from the retaining member, the strap is loosened by relieving the force applied at the fulcrum end of the lever member, said retaining member comprising a generally U-shaped member whose base is securable to said strap and whose legs are flexible and include means for releasably retaining the retaining end of said lever member between said legs, said lever member comprising a longitudinally extending plate means, said retaining end comprising a lateral flange wider than the distance between the flexible legs of the U-shaped retaining member and having, longitudinally anterior to said flange, a portion of a width slightly greater than the normally unbiased distance between the flexible legs of the U-shaped retaining member.

20. A strap tightening device according to claim 19 wherein said lever member is provided with a pair of strap retaining slots adjacent its fulcrum end.

21. A strap tightening device according to claim 20 wherein the lever member is bent at an angle intermediate its retaining and fulcrum ends.

22. A strap tightening device according to claim 21 wherein the upper ends of the legs of the U-shaped retaining member are inwardly and downwardly bent a finite distance less than the height of the legs thereby to define a retaining flange for the retaining end of said lever member when retained in said retaining member.

23. A strap tightening device according to claim 22 made of electrically non-conducting material.

24. A tool holder comprising a resilient continuous one piece open spring loop, a tool holder flexible strap extending between the ends of said spring loop such that the normal bias of said resilient spring loop forms a loop of said strap to secure a tool therewithin and handle means located at one end of the spring loop for forcing one end of said spring loop away from the other end thereby opening said strap loop a sufficient amount to allow the tool to be released therefrom, the end of said spring loop opposite that at which said handle is located being provided with two strap slots, one of said slots being sufficiently large to allow two straps to extend therethrough, one of said straps being one end of said tool holder strap, the other end of said tool holder strap being attached to said handle means.

25. The tool holder according to claim 24 made of electrically non-conducting material.

* * * * *